United States Patent [19]

Edwards

[11] 4,184,221

[45] Jan. 22, 1980

[54] BATH BRUSH

[76] Inventor: Elizabeth G. Edwards, Uptown Station, Arcade, Nashville, Tenn. 37219

[21] Appl. No.: 931,740

[22] Filed: Aug. 7, 1978

[51] Int. Cl.[2] ..... A47K 7/02

[52] U.S. Cl. ..... 15/114; 15/143 R; 15/210 R; 15/231

[58] Field of Search ..... 15/114, 115, 143 R, 15/160, 210 R, 231; D4/12, 31, 32

[56] References Cited

U.S. PATENT DOCUMENTS

| | | | |
|---|---|---|---|
| D. 101,729 | 10/1936 | Bickel | D4/31 X |
| D. 114,198 | 4/1939 | Muller-Munk | D4/32 |
| D. 183,065 | 6/1958 | Schotland | D4/32 |
| D. 192,785 | 5/1962 | Vallis | D4/32 |
| D. 201,866 | 8/1965 | Moore | D4/32 |
| 2,414,321 | 1/1947 | Miller | 15/231 X |
| 3,935,611 | 2/1976 | Locher | 15/160 |

FOREIGN PATENT DOCUMENTS

| | | | |
|---|---|---|---|
| 497822 | 12/1950 | Belgium | 15/247 |
| 136270 | 11/1902 | Fed. Rep. of Germany | 15/114 |
| 158997 | 3/1905 | Fed. Rep. of Germany | 15/114 |
| 822721 | 11/1951 | Fed. Rep. of Germany | 15/114 |
| 857227 | 4/1940 | France | 15/143 R |
| 156964 | 11/1956 | Sweden | 15/160 |

*Primary Examiner*—Philip R. Coe

*Attorney, Agent, or Firm*—Clarence A. O'Brien; Harvey B. Jacobson

[57] ABSTRACT

A bath brush having an elongated, continuously curved element terminating in a handle at one end portion and in a brush arrangement at the other end portion thereof. The element is curved continuously at a rate of curvature comparable to a clothes hanger. The brush arrangement includes an enlarged head forming a substantially planar surface from which project codirectionally a plurality of bristles, with the brush arrangement further including a pair of clips disposed on either side of the bristles for removably holding a face cloth, and the like, on the enlarged head of the element so as to cover the bristles in order to facilitate bathing with the brush.

2 Claims, 4 Drawing Figures

BATH BRUSH

BACKGROUND OF THE INVENTION

1. Field of the Invention

This invention relates generally to brushes, and particularly to a brush suitable for use while bathing.

2. Description of the Prior Art

It is generally known to provide brushes having long handles, an example of which can be found in U.S. Pat. No. 3,431,575, issued Mar. 11, 1969, to A. Petersen, for facilitating the washing of ones back during bathing. U.S. Pat. No. 3,935,611, issued Feb. 3, 1976, to L. Locher, discloses another example of such a brush intended for use in the care and cleaning of the body, and particularly for body massage, which employs a curved handle having a gripping portion at one end and bristles disposed at the other end of the handle.

It is also generally known to provide brushes with retainers for holding a cloth, and the like, for use during dusting and similar functions. Examples of such arrangements can be found in U.S. Pat. Nos.: 682,258, issued Sept. 10, 1901, to S. Jensen; and 3,034,165, issued May 15, 1962, to F. S. Christian. Further, U.S. Pat. No. 1,515,275, issued Nov. 11, 1924, to M. J. Pringle, discloses a window washing and cleaning brush which permits a cleaning cloth to be draped over the brush head, while U.S. Pat. No. 1,373,192, issued Mar. 29, 1921, to O. L. Lance, discloses a brush provided with an arrangement for removably retaining a steel-wool scrubbing pad, and the like, within the brush.

U.S. Pat. No. 1,807,281, issued May 26, 1931, to P. A. Cross, discloses a long handle brush having a removable handle arrangement, while U.S. Pat. No. 1,746,075, issue Feb. 4, 1930, to G. Edwards, discloses a combined massage and bath brush wherein the brush itself is straped onto the body of the user so as to be selectively moved over the surface of the body while in direct contact therewith.

SUMMARY OF THE INVENTION

It is an object of the present invention to provide a bath brush which is simple of construction, yet convenient and efficient to use.

It is another object of the present invention to provide a long handle bath brush having a handle curvature permitting optimum use of the brush for scrubbing ones back during bathing, and similar functions.

Yet another object of the present invention is to provide a bath brush provided with retainers for holding a face cloth, and the like, over the bristles of the brush to further enhance the utility and efficiency of the brush as a bath brush.

These and other objects are achieved according to the present invention by providing a bath brush having an elongated element terminating in a pair of end portions, one of the end portions forming a handle, and with a brush arrangement being provided on the other of the end portions of the element.

The element is curved continuously between the end portions thereof, with the rate of curvature preferably being comparable to that of the curved portion of a conventional wooden clothes hanger, and the like.

The brush arrangement advantageously includes an enlarged head forming a substantially planar surface, with a plurality of bristles extending codirectionally from the planar surface. The planar surface of the head partially forms a concave side of the curved element so that the bristles extend into the concave portion of the brush.

The brush arrangement further includes a retainer assembly provided on the element for movably holding a piece of flexible material, such as a face cloth, on the element in such a manner as to cover the bristles of the brush arrangement. This retainer assembly preferably includes a pair of resilient clips, with one of the clips being arranged on the enlarged head so as to extend from a planar face of the head, which face is disposed substantially parallel to, but spaced from, the substantially planar surface of the head. The other of the clips is arranged on the element adjacent the substantially planar surface of the head, and disposed between the enlarged head and the one of the ends of the element which terminates the handle of the brush.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
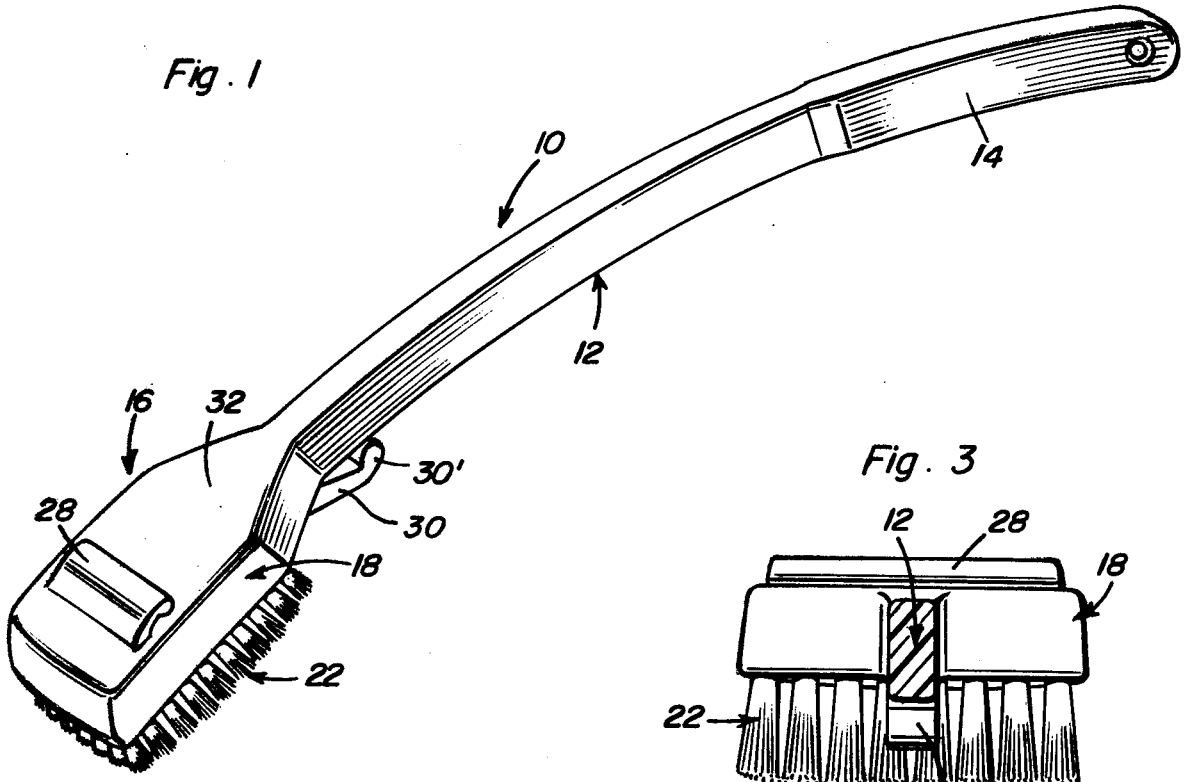
FIG. 1 is a perspective view showing a bath brush according to the present invention.
Figure 3:
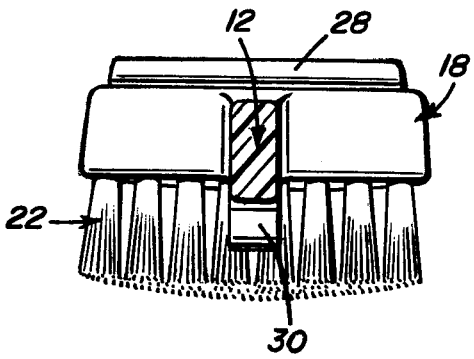
FIG. 3 is an enlarged, sectional view, taken generally along the line 3—3 of FIG. 2.
Figure 2:
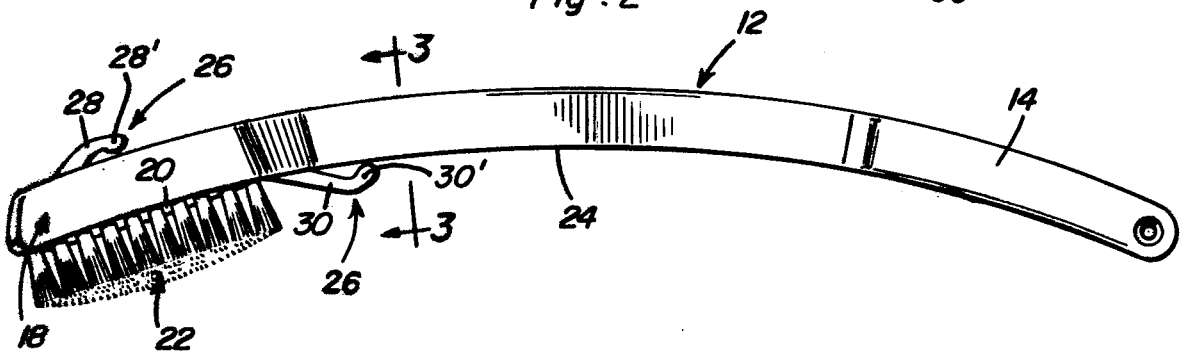
FIG. 2 is a side elevational view showing the brush of FIG. 1.
Figure 4:
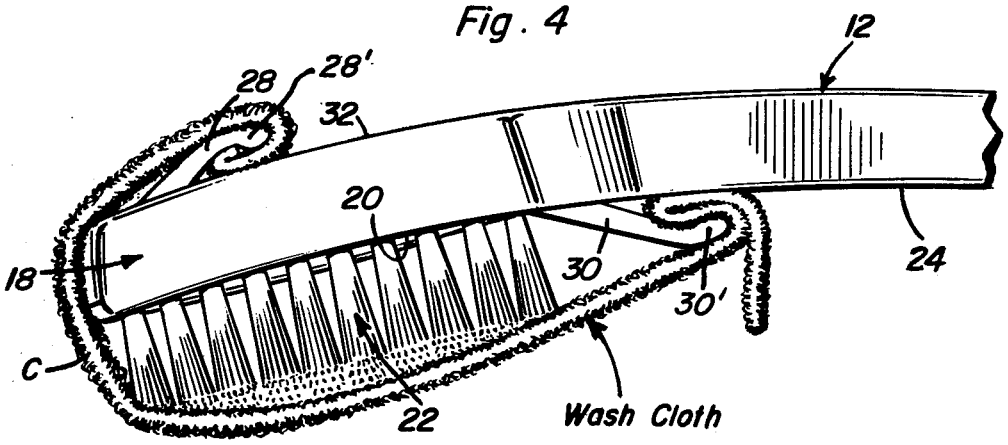
FIG. 4 is an enlarged, fragmentary, side elevational view, showing in detail the left hand portion of FIG. 2, but with a cloth shown disposed covering the bristles of the brush.

Referring now more particularly to the figures of the drawing, a bath brush 10 according to the present invention comprises an elongated element 12 having a pair of end portions, one of the end portions forming a handle 14 and the other of the end portions of element 12 terminating in a brush arrangement 16. As can best be seen from FIG. 2, element 12 is curved continuously between the end portions thereof, with the rate of curvature preferably being comparable to that conventional for the well-known and commonly employed wooden clothes hanger.

Brush arrangement 16 includes an enlarged head 18 forming a substantially planar surface 20, with a plurality of bristles 22 extending codirectionally from such planar surface 20. The latter is disposed partially forming a concave side 24 of element 12.

Brush arrangement 16 further includes a retainer assembly 26 provided on element 12 for removably holding a piece of flexible material, such as face cloth C, on element 12 in a position covering the bristles 22. More specifically, retainer assembly 26 includes a pair of elongated inclined resilient clips 28 and 30 terminating outwardly in inwardly angled terminal ends 28' and 30', with clip 28 being arranged on the enlarged head 18 of element 12 so as to project from a substantially planar face 32 of element 12, face 32 being disposed substantially parallel to, but spaced from, planar surface 20 of head 18, and clip 30 being arranged on element 12 adjacent to surface 20 of head 18, but disposed between head 18 and handle 14 terminating at the one of the end portions of element 12.

Although both surface 20 and face 32 were referred to above as being substantially planar, it will be appreciated that due to the curvature of element 12, surface 20 and face 32 will actually have a slight curvature thereto, although the relatively finite extent of same permit these sides of head 18 to be considered substantially planar.

As can be readily understood from the above description and from the drawing, a bath brush according to the present invention will permit scrubbing of ones arms and backs in a convenient and efficient manner. Further, a cloth C can be clipped onto the brush as by the clips 28 and 30 so as to hold the cloth in place on the brush during certain scrubbing operations. Further, the curvature of the handle forming element of the brush permits normally inaccessible areas of a person's back to be readily reached without inconvenience and strain.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An elongated bath brush structure having remote opposite sides and defining an elongated longitudinal handle portion terminating at one end in an enlarged head, said head including brush bristles extending generally codirectionally from said head outwardly of one of said sides, said head including a first elongated outwardly projecting resilient clip supported from and projecting outwardly of the other side of said structure and inclined outwardly toward the other end of said handle, the outer end of said clip terminating in an inwardly angled terminal end also inclined toward said other handle end and terminating a spaced distance outwardly from said other of said sides, said structure further including a second elongated outwardly projecting resilient clip supported from and projecting outwardly from said one side of said structure and inclined outwardly toward the other end of said handle, the outer end of said second clip also terminating in an inwardly angled terminal end inclined toward said handle other end and terminating a spaced distance outwardly from said one side, said second clip being spaced from said bristles toward the end of said handle portion remote from said head, said second clip being adapted to clampingly engage a first marginal portion of a washcloth between the terminal end of said second clip and said one side of said structure and said first clip being adapted to clampingly engage a remote marginal portion of said washcloth between the terminal end of said first clip and said other side of said structure with the portions of said washcloth extending between the remote marginal portions thereof extending over the outer ends of said bristles and the end of said structure from which said head is supported.

2. The bath brush structure in claim 1, wherein said structure is curved substantially continuously between the opposite ends thereof with said one and other sides being convex and concave, respectively.

* * * * *